US006468946B2

(12) United States Patent
Vinci

(10) Patent No.: US 6,468,946 B2
(45) **Date of Patent: *Oct. 22, 2002**

(54) MIXED PHOSPHORUS COMPOUNDS AND LUBRICANTS CONTAINING THE SAME

(75) Inventor: James N. Vinci, Mayfield Heights, OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 61 days.

(21) Appl. No.: 09/347,962

(22) Filed: Jul. 6, 1999

(65) Prior Publication Data

US 2002/0035042 A1 Mar. 21, 2002

Related U.S. Application Data

(60) Provisional application No. 60/091,757, filed on Jul. 6, 1998.

(51) Int. Cl.[7] ..... C10M 137/08; C10M 137/10; C10M 137/04; C10M 159/20; C10M 141/10

(52) U.S. Cl. ..... 508/398; 508/435; 508/436; 508/437; 508/441

(58) Field of Search ..... 508/435, 436, 508/437, 441, 398

(56) References Cited

U.S. PATENT DOCUMENTS

| | | | | |
|---|---|---|---|---|
| 2,228,658 A | | 1/1941 | Farrington et al. | 252/39 |
| 2,994,408 A | * | 8/1961 | Sorem et al. | 508/441 |
| 3,002,014 A | | 9/1961 | Dinsmore et al. | 250/461 |
| 3,143,507 A | | 8/1964 | Mastin et al. | 252/46.6 |
| 3,200,107 A | | 8/1965 | Le Suer | 260/132 |
| 3,256,185 A | | 6/1966 | Le Suer | 252/32.7 |
| 3,280,031 A | * | 10/1966 | Brennan et al. | 508/441 |
| 3,296,137 A | | 1/1967 | Wiese | 252/48.2 |
| 3,350,348 A | | 10/1967 | Braid et al. | 252/46.6 |
| 3,359,203 A | | 12/1967 | O'Halloran | 252/46.6 |
| 3,361,856 A | | 1/1968 | Le Suer | 260/978 |
| 3,413,227 A | | 11/1968 | Howard et al. | 252/51.5 |
| 3,471,404 A | | 10/1969 | Myers | 252/45 |
| 3,567,638 A | | 3/1971 | Braid | 252/46.7 |
| 3,600,372 A | | 8/1971 | Udelhofen et al. | 260/132 |
| 3,720,616 A | | 3/1973 | Randell et al. | 252/51.5 |
| 3,761,404 A | | 9/1973 | Calow | 252/39 |
| 3,784,588 A | | 1/1974 | Miles et al. | 260/928 |
| 3,788,993 A | | 1/1974 | Andress, Jr. | 252/51.5 |
| 3,816,311 A | | 6/1974 | Malec | 252/46.7 |
| 3,897,351 A | | 7/1975 | Davis et al. | 252/34 |
| 3,912,641 A | | 10/1975 | Wiese et al. | 252/47.5 |
| 3,914,179 A | | 10/1975 | Byford et al. | 252/32.5 |
| 3,923,669 A | | 12/1975 | Newingham et al. | 252/32.7 |
| 3,923,672 A | | 12/1975 | Durr, Jr. et al. | 252/49.9 |
| 3,926,823 A | | 12/1975 | Durr et al. | 252/49.9 |
| 3,931,022 A | | 1/1976 | Chesluk et al. | 252/47.5 |
| 3,969,237 A | | 7/1976 | Andress, Jr. | 252/49.9 |
| 3,979,308 A | | 9/1976 | Mead et al. | 252/32.5 |
| 3,986,967 A | | 10/1976 | Okorodudu | 252/49.9 |
| 4,014,894 A | | 3/1977 | Andress, Jr. | 260/308 |
| 4,031,023 A | | 6/1977 | Musser et al. | 252/48.2 |
| 4,032,461 A | | 6/1977 | Hoke | 252/46.7 |
| 4,048,082 A | | 9/1977 | Nnadi et al. | 252/51.5 |
| 4,060,491 A | | 11/1977 | Bridger et al. | 252/50 |
| 4,096,077 A | | 6/1978 | Swakon | 252/33.6 |
| 4,100,082 A | | 7/1978 | Clason et al. | 252/33.4 |
| 4,115,288 A | | 9/1978 | Schmitt | 252/50 |
| 4,119,549 A | | 10/1978 | Davis | 252/45 |
| 4,153,562 A | | 5/1979 | Jaruzelski | 252/46.6 |
| 4,153,565 A | | 5/1979 | Braid et al. | 252/51.5 |
| 4,161,475 A | | 7/1979 | Davis | 260/132 |
| 4,162,225 A | | 7/1979 | Braid | 252/50 |
| 4,174,284 A | | 11/1979 | Borel et al. | 252/48.6 |
| 4,174,285 A | | 11/1979 | Braid | 252/51.5 |
| 4,181,619 A | | 1/1980 | Schmitt et al. | 252/32.5 |
| 4,187,186 A | | 2/1980 | Braid | 252/51.5 |
| 4,191,659 A | | 3/1980 | Davis | 252/45 |
| 4,197,210 A | | 4/1980 | Bridger | 252/50 |
| 4,200,545 A | | 4/1980 | Clason et al. | 252/33.4 |
| 4,208,357 A | | 6/1980 | Hoke | 260/978 |
| 4,251,469 A | | 2/1981 | Zinke et al. | 260/942 |
| 4,263,150 A | | 4/1981 | Clason et al. | 252/32.7 |
| 4,282,171 A | | 8/1981 | Hoke | 260/928 |
| 4,417,990 A | | 11/1983 | Clason et al. | 252/32.7 |
| 4,456,539 A | | 6/1984 | Shim | 252/46.7 |

(List continued on next page.)

FOREIGN PATENT DOCUMENTS

| | | |
|---|---|---|
| CA | 1168222 | 5/1984 |
| EP | 0216909 | 2/1990 |
| GB | 1347845 | 2/1974 |
| GB | 1365288 | 8/1974 |
| GB | 2071139 | 9/1981 |
| WO | 86/06092 | 10/1986 |
| WO | 88/03554 | 5/1988 |
| WO | 89/04358 | 5/1989 |

OTHER PUBLICATIONS

International Search Report PCT/US88/03723, mailed Oct. 21, 1988.

*Primary Examiner*—Jerry D. Johnson
(74) *Attorney, Agent, or Firm*—Michael F. Esposito

(57) ABSTRACT

This invention relates to a lubricating composition comprising a major amount of an oil of lubricating viscosity and (A) a di or trihydrocarbyl phosphite, (B) at least one reaction product of a di or trihydrocarbyl phosphite and sulfur or a source of sulfur; at least one di or trihydrocarbyl monothiophosphate; or salt thereof, and (C) a salt of a hydrocarbyl phosphoric acid ester. In one embodiment, the lubricant composition contains less than 0.1% phosphorus or less than about 0.75% borated dispersant. This combination of phosphorus compounds provides antiwear and thermal stability to lubricants, even at low phosphorus levels. The lubricating compositions containing the combination of the phosphorus compounds has low corrosivity to copper and low odor as well.

25 Claims, No Drawings

U.S. PATENT DOCUMENTS

| | | | | | |
|---|---|---|---|---|---|
| 4,466,894 | A | | 8/1984 | Grover | 252/32.7 |
| 4,505,718 | A | | 3/1985 | Dorer, Jr. | 44/66 |
| 4,505,830 | A | | 3/1985 | Vinci | 252/33 |
| 4,507,215 | A | | 3/1985 | Schroeck | 252/32.7 |
| 4,584,113 | A | | 4/1986 | Walsh | 252/45 |
| 4,609,480 | A | | 9/1986 | Hata et al. | 252/32.7 |
| 4,612,129 | A | | 9/1986 | Di Biase et al. | 252/33.6 |
| 4,627,928 | A | | 12/1986 | Karn | 252/33 |
| 4,659,488 | A | | 4/1987 | Vinci | 252/33 |
| 4,670,169 | A | | 6/1987 | Adams et al. | 252/46.7 |
| 4,800,031 | A | | 1/1989 | Di Biase et al. | 252/47.5 |
| 4,822,507 | A | * | 4/1989 | Kanamori et al. | 508/436 |
| 4,853,139 | A | | 8/1989 | Ichihashi | 252/32.7 |
| 4,954,273 | A | | 9/1990 | Denis et al. | 252/39 |
| 5,064,546 | A | * | 11/1991 | Dasai | 508/441 |
| 5,254,272 | A | * | 10/1993 | Walters et al. | 508/435 |
| 5,342,531 | A | * | 8/1994 | Walters et al. | 508/436 |
| 5,382,374 | A | * | 1/1995 | Takemitsu et al. | 508/437 |
| 5,486,300 | A | * | 1/1996 | Salomon et al. | 508/436 |
| 5,536,423 | A | * | 7/1996 | Miyagawa et al. | 508/436 |
| 5,595,963 | A | | 1/1997 | Puckace et al. | 508/421 |
| 5,792,731 | A | * | 8/1998 | Ichihashi et al. | 508/441 |
| 5,792,733 | A | * | 8/1998 | Minami et al. | 508/441 |
| 5,972,854 | A | * | 10/1999 | Ichihashi et al. | 508/436 |

* cited by examiner

MIXED PHOSPHORUS COMPOUNDS AND LUBRICANTS CONTAINING THE SAME

CROSS REFERENCE TO PROVISIONAL APPLICATION

This application claims priority from provisional application Ser. No. 60/091,75.7 filed Jul. 6, 1998, the entire disclosure of which is hereby incorporated by reference.

TECHNICAL FIELD OF THE INVENTION

This invention relates to lubricating compositions which provide improved antiwear and thermal stability properties. The lubricating compositions comprise a combination of (A) at least one di or trihydrocarbyl phosphite, (B) at least one reaction product of a di or trihydrocarbyl phosphite and sulfur or a source of sulfur; at least one di or trihydrocarbyl monothiophosphate; or salt thereof, and (C) at least one salt of a hydrocarbyl phosphoric acid ester.

BACKGROUND OF THE INVENTION

Lubricating compositions are used to prevent damage to machinery under operating conditions. Especially under boundary lubrication conditions, a lubricant must act to minimize harmful metal-to-metal contact. Often additives are useful at providing protection under boundary lubricating condition but sometimes these additive adversely affect other performance characteristics. For instance, a lubricant must still provide protection under high speed, shock loading condition, while not be corrosive to copper and other soft metals.

Phosphorus compounds have been used in lubricants to provide antiwear and antioxidation properties to lubricants. Phosphorus compounds generally protect metal from the effects of low speed and heavy load conditions. When the total level of phosphorus provided by the lubricant is below 0.1% by weight there have often been problems with the ability of the lubricant to provide the needed antiwear protection. In the past boron compounds, such as borated dispersants, provide thermal stability and cleanliness. It is desirable to provide additives for lubricants which provide improved antiwear properties and thermal stability.

SUMMARY OF THE INVENTION

This invention relates to a lubricating composition comprising a major amount of an oil of lubricating viscosity and (A) a di or trihydrocarbyl phosphite, (B) at least one reaction product of a di or trihydrocarbyl phosphite and sulfur or a source of sulfur; at least one di or trihydrocarbyl monothiophosphate; or salt thereof, and (C) a salt of a hydrocarbyl phosphoric acid ester. In one embodiment, the lubricant composition contains less than 0.1% phosphorus or less than about 0.75% borated dispersant. This combination of phosphorus compounds provides antiwear and thermal stability to lubricants, even at low phosphorus levels. The lubricating compositions containing the combination of the phosphorus compounds has low corrosivity to copper and low odor as well.

DETAILED DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic-and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. pyridyl, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is hydrocarbon.

Generally the total phosphorus for the lubricant is determined by the amount of all phosphorus components added to the lubricant. The amount of phosphorus in the lubricating composition is sufficient to provide a pass result in the ASTM L-37 test. The total phosphorus is usually less than about 0.1%, or less than 0.09%, or less than about 0.08% by weight. In one embodiment, the phosphorus compounds of the present invention are present at phosphorus contents of less than about 0.07, or less than about 0.06% by weight phosphorus.

As described above the lubricating composition comprise a combination of (A) at least one di or trihydrocarbyl phosphite, (B) at least one reaction product of a phosphite and sulfur or a source of sulfur; at least one di or trihydrocarbyl monothiophosphate; or salt thereof, and (C) at least one salt of a hydrocarbyl phosphoric acid ester. Each component of the combination may be independently present in an amount to provide from about 0.01% to about 0.06%, or from about 0.012% to about 0.05%, or from about 0.018% to about 0.04% by weight phosphorus to the lubricant. Here, as well as elsewhere in the specification and claims, the range and ratio limits may be combined. In one embodiment, each component is present in substantially equal phosphorus proportions. In another embodiment, each component is independently present in an amount from about 0.05% to about 2%, or from about 0.08% to about 1%, or from about 0.1°% to about 0.6% by weight.

As described herein and in the appended claims, it is understood that any element listed within a genus or list may be excluded from the claims.

(A) Phosphites

As described above the lubricating compositions, concentrates, and greases contain at least one phosphite. The phosphite may be a di- or trihydrocarbyl phosphite. Preferably each hydrocarbyl group contains from 1 to about 24 carbon atoms, or from 1 to about 18 carbon atoms, or from about 2 to about 8 carbon atoms. Each hydrocarbyl group may be independently alkyl, alkenyl, or aryl, preferably alkyl or alkenyl. When the hydrocarbyl group is an aryl group, then it contains at least about 6 carbon atoms; preferably about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. Preferably each hydrocarbyl group is independently propyl, butyl, pentyl, hexyl, heptyl, oleyl or phenyl, more preferably butyl, oleyl or phenyl and more preferably butyl or oleyl. In one embodiment, the phosphite is an alkyl or alkyenyl, preferably an alkyl phosphite. In another embodiment, the lubricating compositions are free of phosphites with hydrocarbyl groups that are aryl groups. One method of preparing phosphites includes reacting a lower ($C_{1-8}$) Phosphites and their preparation are known and many phosphites are available commercially. Particularly useful phosphites are dibutyl hydrogen phosphite, dioleyl hydrogen phosphite, di($C_{14-18}$) hydrogen phosphite, and triphenyl phosphite.

In another embodiment, the phosphite is premixed with a overbased metal salt of an organic acid, wherein the equivalents of overbased metal salt, based on total base number to the equivalents of phosphite (A) based on phosphorus atoms is at least one. The inventors have discovered that by pre-mixing the phosphite in the overbased metal salt of an acidic organic compound, the hydrostability of the phosphite is improved. Overbased metal compositions are characterized by having a metal content in excess of that which would be present according to the stoichiometry of the metal and the acidic organic compound. The amount of excess metal is commonly expressed in metal ratio. The term "metal ratio" is the ratio of the total equivalents of the metal to the equivalents of the acidic organic compound. A salt having a metal ratio of 4.5 will have 3.5 equivalents of excess metal. The overbased salts generally have a metal ratio from about 1.5 up to about 40, or from about 2 up to about 30, or from about 3 up to about 25.

The overbased materials are prepared by reacting an acidic material, typically carbon dioxide, with a mixture comprising an acidic organic compound, a reaction medium comprising at least one inert, organic solvent for the acidic organic compound, a stoichiometric excess of a basic metal compound, and a promoter. Generally, the basic metal compounds are oxides, hydroxides, chlorides, carbonates, and phosphorus acids (phosphonic or phosphoric acid) salts, and sulfur acid (sulfuric or sulfonic) salts. The metals of the basic metal compounds are generally alkali, alkaline earth, and transition metals. Examples of the metals of the basic metal compound include sodium, potassium, lithium, magnesium, calcium, barium, titanium, manganese, cobalt, nickel, copper, and zinc, preferably sodium, potassium, calcium, and magnesium, more preferably calcium and magnesium.

The acidic organic compounds useful in making the overbased compositions of the present invention include carboxylic acylating agents, such as polyalkenyl succinic anhydrides, sulfonic acids, phosphorus-containing acids, phenols, or mixtures of two or more thereof. Preferably, the acidic organic compounds are carboxylic acylating agents, sulfonic acids, or phenates. In one embodiment the overbased material is a calcium or magnesium, preferably magnesium, overbased sulfonate or salicylate.

The methods for preparing the overbased materials, as well as overbased materials, are known in the prior art and are disclosed, for example, in the following U.S. Pat. Nos. 2,616,904; 2,616,905; 2,616,906; 3,242,080; 3,250,710; 3,256,186; 3,274,135; 3,492,231; and 4,230,586. These patents disclose processes, materials, which can be overbased, suitable metal bases, promoters, and acidic materials, as well as a variety of specific overbased products useful in producing the overbased systems of this invention and are, accordingly, incorporated herein by reference for these disclosures.

(B) Thiophosphate or Reaction Products of Phosphite and Sulfur or a Source of Sulfur As described above the lubricating compositions, concentrates, and greases contain at least one reaction product of a phosphite and sulfur or a source of sulfur; at least one thiophosphate; or a salt thereof. Component (B) may be a dihydrocarbyl thiophosphate, a trihydrocarbyl thiophosphate, or mixture thereof. In one embodiment, the phosphites used to make component (B) may be any of the above described phosphites. Preferably this phosphite is a trihydrocarbyl phosphite, more preferably a triaryl phosphite. The hydrocarbyl group typically contain from about 4 to about 24, or from about 5 to about 18, or from about 6 to about 12 carbon atoms. Examples of useful hydrocarbyl groups include benzyl, methylbenzyl, dimethylbenzyl, methoxyphenyl, etc. A particularly useful phosphite for preparing component (B) is triphenylphosphite.

As discussed above the phosphite is reacted with sulfur or a source of sulfur. The sulfur source may be any of a variety of materials which are capable of supplying sulfur to the reaction. Examples of useful sulfur sources include sulfur halides, combinations of sulfur or sulfur oxides with hydrogen sulfide, and various sulfur containing organic compounds. The sulfur halides include sulfur monochloride, sulfur dichloride, etc. The sulfur sources may also be sulfur containing organic compounds, such as aromatic and alkyl sulfides, dialkenyl sulfides, sulfurized olefins, sulfurized oils, sulfurized fatty acid esters, sulfurized aliphatic esters of olefinic mono- or dicarboxylic acids, diester sulfides, sulfurized Diels-Alder adducts and sulfurized terpenes. U.S. Pat. No. 4,755,311 discloses various sulfur sources capable of supplying sulfur to reaction. This patent is incorporated by reference for its disclosure of sulfur sources. The sulfur source may also be those sulfur compounds disclosed below.

In one embodiment, the component (B) is at least one compound of the structure:

$$(RX)_3P{=}X$$

where each X is independently sulfur or oxygen, provided that at least one X is sulfur, and wherein each R is independently a hydrocarbyl group. The hydrocarbyl groups are described above. In one embodiment, the hydrocarbyl groups for the above formula are those described for the phosphites above.

Triphenylthiophosphate is sold by Ciba-Geigy under the trade name Irgalube TPPT™. Other suitable monothiophosphates include tricresylthiophosphate, tri-p-dodecylphenylthiophosphate, trioctylthiophosphate, tri-p-t-butylphenylthiophosphate, tri-β-naphthylthiophosphate, trilaurylthiophosphate, tri-p-heptylphenylthiophosphate, thiophosphates based on sulfur-coupled alkylphenols.

The following example relates to preparation of thiophosphates.

EXAMPLE P-1

A reaction vessel is charged with 1204 parts (3.69 equivalents) of triphenylphosphite. The phosphite is heated to 160° C. under nitrogen where 112 parts (3.51 equivalents) of sulfur is added over three hours. The reaction temperature is maintained at 160° C. for four hours. (In an alternative process, the mixture is thereafter heated to 195–200° C. and maintained at that temperature for a period of hours.) The mixture is then filtered through diatomaceous earth and the filtrate is the desired product. The filtrate contains 8.40% phosphorous (8.7% theory) and 8.4% sulfur (8.50% theory).

(C) Ammonium Salt of Phosphoric Acid Esters

As described above, the lubricating compositions of the present invention may also include at least one ammonium salt of at least one phosphoric acid ester.

The ammonium salt of a phosphoric acid ester is prepared by reacting a phosphoric acid ester with ammonia or a basic nitrogen compound, such as an amine or a basic nitrogen containing dispersant. The salts may be formed separately, and then the salt of the phosphorus acid ester may be added to the lubricating composition. Alternatively, the salts may also be formed in situ when the acidic phosphorus acid ester is blended with other components to form a fully formulated lubricating composition. In one embodiment, the ammonium salts of the phosphorus acid ester are sulfur free.

The ammonium salts of the phosphorus acid esters may be formed from ammonia or an amine. These amines may be monoamines or polyamines. The amines include fatty amines, hydroxy amines, fatty diamines, tertiary aliphatic primary amines, and heterocyclic amines. Useful amines include those disclosed in U.S. Pat. No. 4,234,435 at Col. 21, line 4 to Col. 27, line 50, this section of this reference being incorporated herein by reference.

The monoamines generally contain from 1 to about 24 carbon atoms, or from 1 to about 12 carbon atoms, or from 1 to about 6. Examples of monoamines include methylamine, ethylamine, propylamine, butylamine, 2-ethylhexylamine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

In one embodiment, the amine is a fatty ($C_{8-30}$) amine which include n-octylamine, n-decylamine, n-dodecylamine, n-tetradecylamine, n-hexadecyl-amine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen OL, Armeen T, Armeen HT, Armeen S and Armeen SD, wherein the letter designation relates to the fatty group, such as coco, oleyl, tallow, or stearyl groups.

In one embodiment, the amine may be a hydroxyamine. Typically, the hydroxyamines are primary, secondary, or tertiary alkanol amines or mixtures thereof. Such amines can be represented by the formulae: $H_2$—N—R'—OH, H($R'_2$)N—R'—OH, and $(R'_1)_2$—N—R'—OH, wherein each $R'_1$ is independently a hydrocarbyl group having from one to about eight carbon atoms or hydroxyhydrocarbyl group having from one to about eight carbon atoms, or from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group, such as an ethylene, 1,2-propylene, 1,2-butylene, and 1,2-octadecylene groups. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$, is independently a methyl, ethyl, propyl, butyl, pentyl or hexyl group. Examples of these alkanolamines include mono-, di-, and triethanolamine, diethylethanolamine, ethylethanolamine, butyldiethanolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of an epoxides, such as epoxides containing from 2 to about 30, or from about 2 to about 8 carbon atoms, such as ethylene oxide, propylene oxide, butylene oxide, $C_6$ epoxide, etc., with aforedescribed amines and may be represented by the formulae: $H_2N$—$(R'O)_x$—H, H($R'_1$)—N—$(R'O)_x$—H, and $(R'_1)_2$—N—$(R'O)_x$—H, wherein x is a number from about 2 to about 15 and $R'_1$, and R' are as described above. $R'_1$ may also be a hydroxypoly(hydrocarbyloxy) group.

In another embodiment, the amine is a hydroxyamine which may be represented by the formula

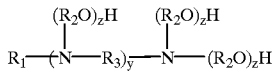

wherein $R_1$ is a hydrocarbyl group containing from about 6 to about 30 carbon atoms; $R_2$ is an alkylene group having from about two to about twelve carbon atoms, preferably an ethylene or propylene group; $R_3$ is an alkylene group containing from 1 up to about 8, or from 1 up to about 5 carbon atoms; y is zero or one; and each z is independently a number from zero to about 10, with the proviso that at least one z is zero.

Useful hydroxyhydrocarbyl amines where y in above formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

In one embodiment, the amine may be a hydroxyhydrocarbyl amine, where referring to the above formula, y equals zero. These hydroxyhydrocarbyl amines are available from the Akzo Chemical Division of Akzona, Inc., Chicago, Ill., under the general trade designations "Ethomeen" and "Propomeen". Specific examples of such products include: Ethomeen C/15, which is an ethylene oxide condensate of a coconut fatty acid containing about 5 moles of ethylene oxide; Ethomeen C/20 and C/25, which are ethylene oxide condensation products from coconut fatty acid containing about 10 and 15 moles of ethylene oxide, respectively; Ethomeen O/12, which is an ethylene oxide condensation product of oleyl amine containing about 2 moles of ethylene oxide per mole of amine; Ethomeen S/15 and S/20, which are ethylene oxide condensation products with stearyl amine containing about 5 and 10 moles of ethylene oxide per mole of amine, respectively; Ethomeen T/12, T/15 and T/25, which are ethylene oxide condensation products of tallow amine containing about 2, 5 and 15 moles of ethylene oxide per mole of amine, respectively; and Propomeen O/12, which is the condensation product of one mole of oleyl amine with 2 moles propylene oxide.

The amine may also be a polyamine. The polyamines include alkoxylated diamines, fatty polyamine diamines, alkylenepolyamines, hydroxy containing polyamines, condensed polyamines, arylpolyamines, and hetero-cyclic polyamines. Commercially available examples of alkoxylated diamines include those amines where y in the above formula is one. Examples of these amines include Ethoduomeen T/13 and T/20, which are ethylene oxide condensation products of N—tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

In another embodiment, the amine is an alkylenepolyamine. Alkylenepolyamines are represented by the formula $HR_4N$-(Alkylene-N)$_n$—$(R_4)_2$, wherein each $R_4$ is independently hydrogen; or an aliphatic or hydroxy-substituted aliphatic group of up to about 30 carbon atoms; n is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, $R_4$ is defined the same as $R'_1$ above. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetraamine, 21.74% tetraethylenepentaamine and 76.61% pentaethylenehexamine and higher analogs. These alkylenepolyamine bottoms include cyclic condensation products such as piperazine and higher analogs of diethylenetriamine, triethylenetetramine and the like.

Another useful polyamine is a condensation reaction between at least one hydroxy compound with at least one polyamine reactant containing at least one primary or secondary amino group. The hydroxy compounds are preferably-polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl) ethylenediamine, and N,N,N',N'-tetrakis(2-hydroxyethyl) ethylenediamine, preferably tris(hydroxymethyl) aminomethane (THAM).

Polyamines which may react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO 86/05501 and U.S. Pat. No. 5,230,714 (Steckel) which are incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris(hydroxymethyl)aminomethane (THAM).

In another embodiment, the polyamines are polyoxyalkylene polyamines, e.g. polyoxyalkylene diamines and polyoxyalkylene triamines, having average molecular weights ranging from about 200 to about 4000, or from about 400 to about 2000. The preferred polyoxyalkylene polyamines include the polyoxyethylene and polyoxypropylene diamines and the polyoxypropylene triamines. The polyoxyalkylene polyamines are commercially available and may be obtained, for example, from the Jefferson Chemical Company, Inc. under the trade name "Jeffamines D-230, D-400, D-1000, D-2000, T-403, etc.". U.S. Pat. Nos. 3,804,763 and 3,948,800 are expressly incorporated herein by reference for their disclosure of such polyoxyalkylene polyamines and acylated products made therefrom.

In another embodiment, the polyamines are hydroxy-containing polyamines. Hydroxy-containing polyamine analogs of hydroxy monoamines, particularly alkoxylated alkylenepolyamines, e.g., N,N-(diethanol)ethylene diamines can also be used. Such polyamines can be made by reacting the above-described alkyleneamines with one or more of the above-described epoxides. Similar alkylene oxide-alkanol amine reaction products may also be used such as the products made by reacting the above described primary, secondary or tertiary alkanolamines with ethylene, propylene or higher epoxides in a 1.1 to 1 .2 molar ratio. Reactant ratios and temperatures for carrying out such reactions are known to those skilled in the art. Specific examples of hydroxy-containing polyamines include N-(2-hydroxyethyl)

ethylenediamine, N,N'-bis(2-hydroxyethyl)-ethylenediamine, 1-(2-hydroxyethyl)piperazine, mono (hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the above described polyamines are also useful.

Other useful amines include primary ether amines, such as those represented by the formula, $R''(OR')_xNH_2$, wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear $C_{16}$), SURFAM P17B (tridecyloxypropylamine). The carbon chain lengths (i.e., $C_{14}$, etc.) of the SURFAM amines described above and used hereinafter are approximate and include the oxygen ether linkage.

In one embodiment, the amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines represented by the formula $R_5—C(R_6)_2—NH_2$, wherein $R_5$ is a hydrocarbyl group containing from 1 to about 27 carbon atoms and $R_6$ is a hydrocarbyl group containing from 1 to about 12 carbon atoms. Such amines are illustrated by t-butylamine, t-hexylamine, 1-methyl-1-amino-cyclohexane, t-octylamine, t-decylamine, t-dodecylamine, t-tetradecylamine, t-hexadecylamine, t-octadecylamine, t-tetracosanylamine, and t-octacosanylamine.

Mixtures of tertiary aliphatic amines may also be used in preparing the dithiocarbamic acid or salt. Illustrative of amine mixtures of this type are "Primene 81R" which is a mixture of $C_{11}$–$C_{14}$ tertiary alkyl primary amines and "Primene JMT" which is a similar mixture of $C_{18}$–$C_{22}$ tertiary alkyl primary amines (both are available from Rohm and Haas Company). The tertiary aliphatic primary amines and methods for their preparation are known to those of ordinary skill in the art. The tertiary aliphatic primary amine useful for the purposes of this invention and methods for their preparation are described in U.S. Pat. No. 2,945,749, which is hereby incorporated by reference for its teaching in this regard.

In another embodiment, the polyamine is a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The phosphoric acid ester may be prepared by reacting one or more phosphorus acids or anhydrides with one or more alcohols each independently containing from one to about 30, or from two to about 24, or from about 3 to about 12 carbon atoms. The phosphorus acid or anhydride is generally an inorganic phosphorus reagent, such as phosphorus pentoxide, phosphorus trioxide, phosphorus tetroxide, phosphorous acid, phosphoric acid, phosphorus halide, or one or more $C_{1-7}$ phosphorus esters. Alcohols used to prepare the phosphoric acid esters include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of $C_{18}$–$C_{28}$ primary alcohols having mostly $C_{20}$ alcohols as determined by GLC (gas-liquid-chromatography); and Alfol 22+ alcohols ($C_{18}$–$C_{28}$ primary alcohols containing primarily $C_{22}$ alcohols). Alfol alcohols are available from Continental Oil Company. Another example of a commercially available alcohol mixtures are Adol 60 (about 75% by weight of a straight chain $C_{22}$ primary alcohol, about 15% of a $C_{20}$ primary alcohol and about 8% of $C_{18}$ and $C_{24}$ alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_{12}$ and $C_{15}$ alcohols; and Neodol 45 is a mixture of $C_{14}$ to $C_{15}$, linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha-olefin fraction of $C_{11}$–$C_{14}$, and the latter is derived from a $C_{15}$–$C_{18}$ alpha-olefin fraction.

The following examples relate to amine salts of phosphoric acid esters. Unless the context indicates otherwise, temperatures are in degrees Celsius, pressure is atmospheric, and the parts and percentages are by weight.

EXAMPLE P-2

To a fatty alcohol (6 moles) having an average of 13 carbon atoms and obtained by the hydrogenation of coconut oil there is added at 50–80° C. within a period of 2.5 hours, 2 moles of phosphorus pentoxide. The mixture is heated at 80° C. for 3 hours and filtered. The filtrate is the desired partially esterified phosphoric acid, having a phosphorus content of 8.5% and an acid number of 216 (phenolphthalein indicator). To 518 grams (2 acid equivalents.) of this acidic ester there is added at 35–60° C. a stoichiometrically equivalent amount (i.e., 2 equivalents) of Primene 81-R, a commercial tertiary- alkyl primary amine mixture having from 11 to 14 carbon atoms in the alkyl group and an average equivalent weight of 191 (based on nitrogen). The resulting mixture is agitated for 30 minutes. The product is a salt of the amine and the acidic ester having a phosphorus content of 4.7% and a nitrogen content of 3.1%.

EXAMPLE P-3

A salt is prepared by the procedure of Example P-2 except that the partially esterified phosphoric acid used is derived from a mixture of 3 moles of primary-pentyl alcohol and I mole of phosphorus pentoxide.

EXAMPLE P-4

Alfol 8–10 (2628 parts, 18 moles) is heated to a temperature of about 45° C. whereupon 852 parts (6 moles) of phosphorus pentoxide are added over a period of 45 minutes while maintaining the reaction temperature between about 45–65° C. The mixture is stirred an additional 0.5 hour at this temperature, and is there-after heated at 70° C. for about 2–3 hours. Primene 81-R (2362 parts, 12.6 moles) is added dropwise to the reaction mixture while maintaining the temperature between about 30–50° C. When all of the amine has been added, the reaction mixture is filtered through a filter aid, and the filtrate is the desired amine salt containing 7.4% phosphorus (theory, 7.1%).

EXAMPLE P-5

To 1000 parts (3.21 moles) of an alkyl phosphoric acid ester mixture prepared as in Example P-4, there is added 454 parts (3.7 moles) of di-n-butyl amine and maintaining an atmosphere of nitrogen. Over the period of addition, the reaction mixture is heated to and maintained at a temperature of 120° C. After all of the butyl amine has been added, the mixture is maintained at 120° C. for 8 hours. The desired amine salt is obtained and contains 7.1% phosphorus (theory, 6.8%) and 3.4% nitrogen (theory, 3.6%).

EXAMPLE P-6

A reaction vessel is charged with 793.4 parts (9 moles) of n-amyl alcohol, and 426 parts (3 moles) of phosphorus pentoxide is added over a period of 1.5 hours incrementally while maintaining the reaction temperature between about 55–70° C. After all of the phosphorus pentoxide has been added, the mixture is stirred for 0.5 hour. The reaction mixture then is maintained at 70° C. for 3 hours. Primene 81-R (1597.9 parts, 5.93 moles) is added dropwise to the reaction mixture while maintaining the temperature between 50–70° C. After all of the Primene 81-R has been added, the reaction mixture is filtered through a filter aid to yield the desired amine salt containing 6.1% phosphorus (theory, 5.8%).

EXAMPLE P-7

Isoctyl alcohol (three equivalents) is heated to 65° C. where phosphorus pentoxide (two equivalents based on phosphorus) is added incrementally while maintaining the temperature between 65 and 90° C. The reaction is monitored by neutralization acid number. After completion of the reaction, 2-ethylhexylamine (two equivalents per 3 neutralization acid number) is added incrementally while maintaining the temperature between 65 and 90° C. The resulting product has 7.6% phosphorus, and 3.6% sulfur.

EXAMPLE P-8

A mixture of 539.8 parts (3.7 moles) of Alfol 8–10 and 326 parts (3.7 moles) of n-amyl alcohol is prepared and heated to 30° C. whereupon 350 parts (2.46 moles) of phosphorus pentoxide are added incrementally utilizing a cold water bath to maintain the temperature of the reaction mixture at 50–60° C. After all of the phosphorus pentoxide is added, the mixture is stirred an additional 0.5 hour and thereafter maintained at a temperature of 70° C. for 3 hours. The phosphoric acid mixture is cooled to about 40° C. whereupon 925.6 parts (4.95 moles) of Primene 81-R are added dropwise over a period of 2 hours. The reaction mixture is exothermic to 70° C., and after all of the amine is added, the mixture is filtered through a filter aid and the filtrate is the desired amine salt containing 5.5% phosphorus and 3.2% nitrogen (theory, 3.24%).

Lubricants

As previously indicated, the combination of the phosphorus compounds are useful as additives for lubricants in which they can function primarily as antiwear agents. As described above, the present combination of phosphorus compounds provides antiwear protection of lubricating compositions while not providing adverse consequences to copper corrosion, thermal stability or odor of the lubricating compositions. They may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic or manual transmission fluids, transaxle lubricants, gear lubricants, including open and enclosed gear lubricants, tractor lubricants, metal-working lubricants, hydraulic fluids and other lubricating oil and grease compositions can also benefit from the incorporation therein of the compositions of the present invention. They may also be used as wirerope, walking cam, way, rock drill, chain and conveyor belt, worm gear, bearing, and rail and flange lubricants.

As described above, the lubricating composition contains an oil of lubricating viscosity. The oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydrotreated mineral oil or a synthetic lubricating oil, such as a polyolefin. Examples of useful oils of lubricating viscosity include XHVI basestocks, such as 100N isomerized wax basestock (0.01% sulfur/141 VI), 120N isomerized wax basestock (0.01% sulfur/149 VI), 170N isomerized wax basestock (0.01% sulfur/142 VI), and 250N isomerized wax basestock (0.01% sulfur/146 VI); refined basestocks, such as 250N refined naphthenic mineral oil (0.2% sulfur/60 VI), 100 N solvent refined/hydrotreated paraffinic mineral oil (0.01% sulfur/98 VI), 240N solvent refined/hydrotreated paraffinic mineral oil (0.01% sulfur/98 VI), 80N solvent refined/hydrotreated paraffinic mineral oil (0.08% sulfur/127 VI), and 150N solvent refined/hydrotreated paraffinic mineral oil (0.17% sulfur/127 VI). A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity is a polyalpha-olefin (PAO). Typically, the polyalpha-olefins are derived from monomers having from about 4 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiment, the lubricating composition contains an oil of lubricating viscosity which has an iodine value of less than about 9, Iodine value is determined according to ASTM D-460. In one embodiment, the oil of lubricating viscosity has a iodine value less than about 8, or less than about 6, or less than about 4.

In one embodiment, the oil of lubricating viscosity are selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75W. The lubricating composition may also have a so-called multigrade rating such as SAE 75W-80, 75W-90, 75W-90, 75W-140, 80W-90, 80W-140, 85W-90, or 85W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers available from Rohm & Haas; Shellvis™ rubbers available from Shell Chemical; Trilene™ polymers, such as Trilene™ CP-40, available commercially from Uniroyal Chemical Co., and Lubrizol 3100 series and 8400 series polymers, such as Lubrizol 3174 available from The Lubrizol Corporation.

In one embodiment, the oil of lubricating viscosity includes at least one ester of a dicarboxylic acid. Typically the esters containing from about 4 to about 30, preferably from about 6 to about 24, or from about 7 to about 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Example of ester groups include hexyl, octyl, decyl, and dodecyl ester groups. The ester groups include linear as well as branched ester groups such as iso arrangements of the ester group. A particularly useful ester of a dicarboxylic acid is diisodecyl azelate.

Sulfur Compounds

In one embodiment, the above combination is used in lubricating compositions together with a sulfur compound. In one embodiment, the sulfur compound (a) is present at concentrations in the range from about 0.1% to about 10% by weight, or preferably from about 0.2% up to about 8%, or more preferably from about 0.3% up to about 7%, more preferably from about 0.5% to about 5% by weight.

The sulfur compounds include mono- or polysulfide compositions, or mixtures thereof. The sulfur compounds are generally characterized as having sulfide linkages containing an average from 1 up to about 10, or from about 2 up to about 8, or from about 3 up to about 4 sulfur atoms. In one embodiment, the sulfur compound is a mixture of di-, tri- or tetrasulfide materials, preferably having a majority of trisulfide. Materials having at least 70% trisulfide are preferred, with materials containing greater than 80% trisulfide more preferred. In one embodiment, the sulfur compound contains greater than 15%, or greater than 20%, or greater than 25% by weight sulfur. In one embodiment, the sulfur compound contains from about 15% to about 60%, or from about 20% to about 40% by weight sulfur.

In one embodiment, the sulfur compound is prepared by sulfurizing unsaturated compounds. Materials which may be sulfurized include oils, unsaturated fatty acids, unsaturated fatty esters, olefins, terpenes, or Diels-Alder adducts. Oils which may be sulfurized are natural or synthetic oils, including mineral oils, lard oil, carboxylic acid esters derived from aliphatic alcohols and fatty acids or aliphatic carboxylic acids (e.g., myristyl oleate and oleyl oleate), and synthetic sperm whale oil substitutes and synthetic unsaturated esters or glycerides.

The unsaturated fatty acids generally contain from about 8 to about 30, or from about 12 to about 24 carbon atoms. Examples of unsaturated fatty acids include palmitoleic acid, oleic, linoleic, linolenic, erucic acid, lard oil acid, soybean oil acid, tall oil and rosin acid.

The unsaturated fatty esters include fatty oils, that is, naturally occurring or synthetic esters of glycerol and one or more of fatty acids. Examples of fatty esters include animal fats, such as Neat's-foot oil, lard oil, depot fat, beef tallow, and vegetable oils, including cottonseed oil, corn oil, safflower oil, sesame oil, soybean oil, and sunflower seed oil. The unsaturated fatty esters also may be prepared by esterifying alcohols and polyols with a fatty acid. The alcohols include the above described mono- and polyhydric alcohols, such as methanol, ethanol, propanol, butanol, ethylene glycol, neopentyl glycol, and glycerol.

The olefins, which may be sulfurized, contain at least one olefinic double bond, which is defined as a non-aromatic double bond. In its broadest sense, the olefin may be defined by the formula $R^{*1}R^{*2}C{=}CR^{*3}R^{*4}$, wherein each of $R^{*1}$, $R^{*2}$, $R^{*3}$, and $R^{*4}$ is hydrogen, or an hydrocarbyl group. In general, the $R^*$ groups in the above formula which are not hydrogen may be represented by $—(CH_2)_n—A$, wherein n is a number from 0 to about 10 and A is represented by $—C(R^{*5})_3$, $—COOR^{*5}$, $—CON(R^{*5})_2$, $—COON(R^{*5})_4$, —COOM, —CN, —X, $—YR^{*5}$ or —Ar, wherein: each $R^{*5}$ is independently hydrogen, or a hydrocarbyl group, with the proviso that any two $R^{*5}$ groups may be connected to form a ring of up to about 12 carbon atoms; M is one equivalent of a metal cation (preferably Group I or II, e.g., sodium, potassium, barium, or calcium); X is halogen (e.g., chloro, bromo, or iodo); Y is oxygen or divalent sulfur; Ar is an aromatic group of up to about 12 carbon atoms.

The olefinic compound is usually one in which each R group which is not hydrogen is independently alkyl, alkenyl or aryl group, preferably an alkyl group. In one embodiment, $R^{*3}$ and $R^{*4}$ are hydrogen and $R^{*1}$ and $R^{*2}$ are alkyl or aryl, especially alkyl, having from 1 up to about 30, or from 1 up to about 16, or from 1 up to about 8 carbon atoms. Olefins having from 2 up to about 30, or from about 3 up to about 16 (most often less than about 9) carbon atoms are particularly useful. Olefins having from 2 up to about 8, or from 2 up to about 4 carbon atoms are particularly useful. Isobutene, propylene and their dimers, trimers and tetramers, and mixtures thereof are especially preferred olefins. Of these compounds, isobutylene and diisobutylene are particularly desirable. In one embodiment, the organic polysulfides may be a mixture of di-, tri-, or tetrasulfide materials, preferably having a majority of trisulfide. Materials having at least 70% trisulfide are preferred, with materials containing greater than 80% trisulfide more preferred.

In another embodiment, the organic polysulfide comprise sulfurized olefins prepared by the sulfochlorination of olefins containing four or more carbon atoms and further treatment with inorganic sulfides according to U.S. Pat. No. 2,708,199.

In one embodiment, the sulfurized olefins may be produced by (1) reacting sulfur monochloride with a stoichiometric excess of a lower olefin, e.g. containing two to about seven carbon atoms, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to about 5 carbon atoms and examples include ethylene, propylene, butylene, isobutylene, amylene, etc.

The organic polysulfide may also be the reaction product of a hydrocarbyl mercaptan, sulfur and an olefin. The mercaptans used to make the polysulfide may be hydrocarbyl mercaptans, such as those represented by the formula R—S—H, wherein R is a hydrocarbyl group as defined above. In one embodiment, R is an alkyl, an alkenyl, cycloalkyl, or cycloalkenyl group. R may also be a haloalkyl, hydoxyalkyl, or hydroxyalkyl substituted (e.g. hydroxymethyl, hydroxyethyl, etc.) aliphatic groups. R generally contains from about 2 to about 30 carbon atoms, preferably from about 2 to about 24, more preferably from about 3 to about 18 carbon atoms. Examples include butyl mercaptan, amyl mercaptan, hexyl mercaptan, octyl mercaptan, 6-hydroxymethyl-octanethiol, nonyl mercaptan, decyl mercaptan, 10-amino-dodecanethiol, dodecyl mercaptan, 10-hydroxymethyl-tetradecanethiol, and tetradecyl mercaptan.

The sulfurized olefin may also be prepared by reacting, under superatmospheric pressure, the olefin with a mixture of sulfur and hydrogen sulfide in the presence, or absence, of a catalyst, such as an alkyl amine, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same.

The organic polysulfide generally has hydrocarbyl groups each independently having from about two to about 30, preferably from about two to about 20, and more preferably from about two to about 12. The hydrocarbyl groups may be aromatic or aliphatic, preferably aliphatic. In one embodiment, the hydrocarbyl groups are alkyl groups.

In one embodiment, the sulfur compound contains a mixture comprising at least about 90% dihydrocarbyl trisulfide, from about 0.5% up to about 8% dihydrocarbyl disulfide, and less than about 5% dihydrocarbyl higher polysulfides. Higher polysulfides are defined as containing four or more sulfide linkages. In one embodiment, the amount of trisulfide is at least about 92%, or preferably at least about 93%. In another embodiment, the amount of dihydrocarbyl higher polysulfides is less than 4%, or preferably less than about 3%. In one embodiment, the dihydrocarbyl disulfide is present in an amount from about 0.5% up to about 5%, or preferably from about 0.6% up to about 3%.

The sulfide analysis is performed on a Varian 6000 Gas Chromatograph and FID detector SP-4100 computing integrator. The Column is a 25 m. Megabore SGE BP-1. The temperature profile is 75° C., hold 2 min., to 250° C. at 6° C./min. The helium flow is 6.0 ml/min plus make-up. The injection temperature is 200° C. and the detector temperature is 260° C. The injection size is 0.6, ul. References are the monosulfide, disulfide and trisulfide analogues to the sulfur composition for analysis. The references may be obtained by fractionating the product to form sulfide fractions (S1, S2 and S3) to be used for analysis. The procedure for analysis is as follows. (1) An area % determination is run on each of the reference samples to determine its purity. (2) An area % determination is run on the sample to be tested to get a general idea of its composition. (3) A calibration blend is accurately weighed based on the area % results of the sample to be tested: then the internal standard toluene, is added to the blend in an amount equal to approximately one-half of the weight of the largest component. (This should give an area approximately the same as that of the largest component.) (4) The weights of each component (i.e., S-1, S-2 and S-3) are corrected by the % purity from step 1. (5) The calibration blend is run in triplicate using the corrected weights and then calculated, using the following formula, to reflect the multiple peaks in S-1 and S-2:

$$RF = \frac{\text{(concentration of components*)}}{\text{(total area of peaks)}} \frac{\text{(area of internal standard)}}{\text{(concentration of internal standard)}}$$

*Adjusted for purity of the standard i.e.: component weight times percent purity equals concentration of component (6) These response factors, plus the response factor for the single S-3 peak are used for determining weight percent results for the samples to be tested. (7) Results for S-1 and S-2 are adjusted to include all the peaks attributed to them. (8) Higher polysulfides are determined by difference using the following formula:

$$\text{S-4}=100\%-(\text{S-1}+\text{S-2}+\text{S-3}+\text{light ends})$$

Light ends are defined as any peaks eluded prior to the internal standard.

In one embodiment, the organic polysulfide is prepared as described above using hydrogen sulfide, sulfur, and at least olefin to form an intermediate. The intermediate is fractionally distilled to form the organic polysulfide. In one aspect, the fractional distillation occurs under subatmospheric pressure. Typically the distillation pressure is from about 1 to about 250, preferably from about 1 to about 100, or preferably from about 1 to about 25 mm Hg. A fractionation column, such a Snyder fractionation column may be used. In one embodiment, the fractionation is carried out at a reflux ratio of from about 2:1 up to about 8:1, preferably from about 3:1 up to about 7:1, or preferably from about 4:1 up to about 6:1. S-21.

The following examples relate to sulfurized olefins. Unless the context clearly indicates otherwise, here, as well as throughout the specification and claims, the amounts are by weight, the temperature is in degrees Celsius and the pressure is atmospheric.

EXAMPLE S-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid. The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

EXAMPLE S-2

Sulfur monochloride (2025 grams, 15.0 moles) is heated to 45° C. Through a sub-surface gas sparge, 1468 grams (26.2 moles) of isobutylene gas are fed into the reactor over a 5-hour period. The temperature is maintained between 45–50° C. At the end of the sparging, the reaction mixture increases in weight by 1352 grams. In a separate reaction vessel are added 2150 grams (16.5 moles) of 60% flake sodium sulfide, 240 grams (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is heated to reflux for 6 hours, and afterward the mixture is permitted to form into separate layers. The lower aqueous layer is discarded. The upper organic layer is mixed with two liters of 10% aqueous sodium hydroxide, and the mixture is heated to reflux for 6 hours. The organic layer is again removed and washed with one liter of water. The washed product is dried by heating at 90° C. and 30 mm. Hg. pressure for 30 minutes. The residue is filtered through diatomaceous earth filter aid to give 2070 grams of a clear yellow-orange liquid.

EXAMPLE S-3

Charge 1000 lbs. of the product of Example S-1 to the reactor, under medium agitation, and heat to approximately 88° C.–94° C. Bring to equilibrium and maintain equilibrium for 30 minutes prior to collection of distillate. Set the reflux ratio at 4:1. Raise the temperature to 105° C. to ensure a steady distillation rate. Collection of the distillate will require approximately 20–24 hours and the yield will approximate 230–260 lbs. Raise the temperature to 105° C.–107° C. Bring the system to equilibrium and maintain for 30 minutes prior to collection of distillate. Set the reflux ratio at 4:1. Raise the temperature to 121° C.–124° C., in order to ensure a steady distillation rate. Collect distillate over 75–100 hours. The distillation yields approximately 300–400 lbs. of the desired product. The desired product contains 2.7% S2, 93.15% S3, 4.04% higher polysulfides.

EXAMPLE S-4

In a vessel with a fractionation column, bring 10,000 grams of the product of Example S-1 to a boil, approximately 200° F., under medium agitation. Bring the column to equilibrium by regulating the vapor temperature. Maintain the equilibrium for 30 minutes prior to collection of distillate. Set the reflux ratio at 5:1. Under these conditions, collect the distillate until the accumulation of distillate is less than 5 ml in 15 minutes. Collect 100 ml of the distillate containing 88 grams of distillate at a vapor temperature of 56° C. Raise the temperature of the vessel 15° F. Remove an additional aliquot of 50 grams in 65 ml of distillate, at a vapor temperature of 58° C. Collect 2000 ml of distillate and remove 1838 grams of distillate, continuing collection as long as the distillate rate stays greater than 5 ml/15 minutes. If boiling drops off, raise the temperature of the vessel 5.5° C. Continue collecting distillate until the distillation rate is less than 5 ml/15 minutes is achieved. The distillate contains approximately 473 grams of desired product. For the final collection of distillate, raise the temperature of the vessel 9° C. to 116° C., not exceeding 121 ° C. Remove 220 ml of the distillate, containing 214 grams of distillate at a vapor temperature of 69° C. Continue collection of the remainder of the distillate, containing approximately 4114 grams of the desired product, until the distillation rate is less than 5 ml/15 minutes. A yield after fractionation should approximate 6777 grams of the desired product. The desired product contains approximately 2% S2, 96.6% S3, and 1.3% higher polysulfides. The sulfur compound is typically present in an amount from about 1% to about 10%, or from about 1.5% to about 8%, or from about 2% to about 6% by weight.

Other additives

The above combination of the present invention may be used, in lubricants, in functional fluids or in concentrates, by themselves or in combination with any other known additive which includes, but is not limited to dispersants, antioxidants, anti-wear agents, extreme pressure agents, emulsifiers, demulsifiers, friction modifiers, anti-rust agents, corrosion inhibitors, viscosity improvers, pour point depressants, dyes, and solvents to improve handleability which may include alkyl and/or aryl hydrocarbons. These additives may be present in various amounts depending on the needs of the final product.

Dispersants include but are not limited to hydrocarbon substituted succinimides, succinamides, esters, and Mannich dispersants as well as materials functioning both as dispersants and viscosity improvers. These dispersants are described above as acylated nitrogen compounds, hydrocarbyl substituted amines and Mannich reaction products. The dispersants listed above may be post-treated with reagents such as urea, thiourea, carbon disulfide, aldehydes, ketones, carboxylic acids, hydrocarbon substituted succinic anhydride, nitrites, epoxides, boron compounds, phosphorus compounds and the like.

Antioxidants, corrosion inhibitors, extreme pressure and anti-wear agents include but are not limited to chlorinated aliphatic hydrocarbons; boron-containing compounds including borate esters; and molybdenum compounds.

Viscosity improvers include but are not limited to Polyisobutene, polymethyacrylate acid esters, polyacrylate acid esters, diene polymers, polyalkyl styrenes, alkenyl aryl conjugated diene copolymers, polyolefins and multifunctional viscosity improvers.

Pour point depressants are a particularly useful type of additive often included in the lubricating oils described herein. See for example, page 8 of "Lubricant Additives" by C. V. Smalheer and R. Kennedy Smith (Lesius-Hiles Company Publishers, Cleveland, Ohio, 1967).

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125–162.

These and other additives are described in greater detail in U.S. Pat. No. 4,582,618 (column 14, line 52 through column 17, line 16, inclusive), herein incorporated by reference for its disclosure of other additives that may be used in combination with the present invention.

In one embodiment, the lubricating compositions of the present invention contains less than about 0.75%, or less than about 0.5% borated dispersant. In another embodiment, lubricating compositions are free of borated dispersants and/or alkali or alkaline earth metal borates. In another embodiment, the lubricating compositions are free of imidazoline copper passivating agents.

The following are examples of lubricants useful in the present invention.

EXAMPLE I

A gear lubricant is prepared by incorporating 0.23% of the product of example P-7, 0.12% by weight of dibutyl hydrogen phosphite, and 0.2% by weight of triphenylmonothiophosphate into a SAE 80W-90 lubricating oil mixture.

EXAMPLE II

A gear lubricant is prepared by incorporating 3% of the product of Example S-1, 0.5% by weight of Example P-1, 0.15% dioleyl phosphite, and 0.4% by weight of the product of Example P-7 into an SAE 80W-90 lubricating oil mixture.

EXAMPLE III

A gear lubricant is prepared by premixing 0.09% of a 68 % solution of a magnesium overbased sulfonate (Metal ratio 15, total base number 400) in mineral oil with 0.12% of di-butyl hydrogen phosphite and incorporating the premixed product with 0.23% of the product of Example P-7, and 0.2% by weight of triphenylmonothiophosphate into a SAE 80W-90 lubricating oil mixture.

EXAMPLE IV

A gear lubricant is prepare as described in Example III except 3% of the product of Example S-1 is added gear lubricant.

EXAMPLE V

A gear lubricant is prepared by premixing 0.09% of a 68 % solution of a magnesium overbased sulfonate (Metal ratio 15, total base number 400) in mineral oil with 0.12% of di-butyl hydrogen phosphite and incorporating the premixed product with 0.23% of the product of Example P-7, 0.2% by weight of triphenylmonothiophosphate, 3% of the product of Example S-1, 0.25% oleyl amine, 0.05% of a succinimide dispersant (prepared from polyamines and polyisobutenyl (Mn-1000) succinic anhydride at a reaction ratio of 2 nitrogens per succinic anhydride, and having 2.5% nitrogen, a; TBN of 80 and 40% diluent oil), 0.02% of a polyacrylate pour point depressant of 2-ethylhexyl acrylate and ethyl acrylate, 0.002% of a silicone antifoam agent, 0.21% of pluronic 101 surfactant available from Wyandott, and 0.12% of an oxidatively coupled nonyl mercaptan and dimercaptothiadiazole into a 80W-90 lubricating oil mixture.

The gear lubricant of Example V passed the L-37 high torque test, L-42 high speed shock test, and L-60-1 thermal stability test (21% viscosity increase).

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising a major amount of an oil of lubricating viscosity and (A) a di or trihydrocarbyl phosphite, (B) a reaction product of a di or trihydrocarbyl phosphite and sulfur or a sulfur compound; or a di or trihydrocarbyl monothiophosphate; or salt thereof, and (C) an ammonium salt of a hydrocarbyl phosphoric acid ester.

2. The lubricating composition of claim 1 wherein each hydrocarbyl group of (A), (B) and (C) independently contains from 1 to 30 carbon atoms.

3. A lubricating composition of claim 1 wherein each hydrocarbyl group of (A) and (C) is independently acyclic.

4. The lubricating composition of claim 1 wherein each hydrocarbyl group of (A) and (B) is independently an alkyl group having from about 2 to about 12 carbon atoms.

5. The lubricating composition of claim 1 wherein each hydrocarbyl group of (A) or (C) is independently a propyl, butyl, amyl, 2-ethylhexyl, or octyl group.

6. The lubricating composition of claim 1 wherein each hydrocarbyl group of (B) is independently an aryl group having from 6 to about 18 carbon atoms.

7. The lubricating composition of claim 1 wherein (B) is a triaryl monothiophosphate.

8. The lubricating composition of claim 1 wherein (C) is the amine salt of di or trialkyl phosphoric acid ester.

9. The lubrication composition of claim 1 wherein the lubricating composition contains less than 0.09% by weight phosphorus.

10. The lubricating composition of claim 1 wherein (A), (B), and (C) are present in substantially equal phosphorus proportions.

11. The lubricating composition of claim 1 further comprising a sulfur containing extreme pressure agent.

12. The lubricating composition of claim 11 wherein the sulfur containing extreme pressure agent is an organic polysulfide.

13. The lubricating composition of claim 1 wherein the lubricating composition is a gear oil.

14. A lubricating composition prepared by (A) mixing at least one phosphite and an overbased metal salt to form an intermediate, and (B) mixing the intermediate from step (A) with (1) a reaction product of a di or trihydrocarbyl phosphite with sulfur or a sulfur compound, a di or trihydrocarbyl monothiophosphate; or salt thereof, (2) an ammonium salt of a hydrocarbyl phosphoric acid ester, and (3) a major amount of an oil of lubricating viscosity.

15. The lubricating composition of claim 14 wherein each hydrocarbyl group of (A) and (B) is independently an alkyl group having from about 2 to about 12 carbon atoms.

16. The lubricating composition of claim 14 wherein each hydrocarbyl group of (A) and (C) is independently a propyl, butyl, amyl, 2-ethylhexyl, or octyl group.

17. The lubricating composition of claim 14 wherein each hydrocarbyl group of (B) is independently an aryl group having from 6 to about 18 carbon atoms.

18. The lubricating composition of claim 14 wherein (B) is a triaryl monothiophosphate.

19. The lubricating composition of claim 14 wherein (C) is the amine salt of di or trialkyl phosphoric acid ester.

20. The lubrication composition of claim 14 wherein the lubricating composition contains less than 0.09% by weight phosphorus.

21. The lubricating composition of claim 14 wherein (A), (B), and (C) are present in substantially equal phosphorus proportions.

22. The lubricating composition of claim 14 further comprising a sulfur containing extreme pressure agent.

23. The lubricating composition of claim 22 wherein the sulfur containing extreme pressure agent is an organic polysulfide.

24. The lubricating composition of claim 14 wherein the lubricating composition contains less than about 0.75% borated dispersant.

25. The lubricating composition of claim 14 wherein the lubricating composition is a gear oil.

* * * * *